US007869732B2

(12) United States Patent
Burry et al.

(10) Patent No.: US 7,869,732 B2
(45) Date of Patent: Jan. 11, 2011

(54) AMPLITUDE MODULATION OF ILLUMINATORS IN SENSING APPLICATIONS IN PRINTING SYSTEM

(75) Inventors: Aaron Michael Burry, Ontario, NY (US); Julianna Elizabeth Lin, Rochester, NY (US); Peter Paul, Webster, NY (US)

(73) Assignee: Xerox Corporation, Norwalk, CT (US)

( * ) Notice: Subject to any disclaimer, the term of this patent is extended or adjusted under 35 U.S.C. 154(b) by 393 days.

(21) Appl. No.: 12/167,428

(22) Filed: Jul. 3, 2008

(65) Prior Publication Data

US 2010/0003044 A1 Jan. 7, 2010

(51) Int. Cl.
*G03G 15/00* (2006.01)
*G03G 15/01* (2006.01)
*G03G 15/02* (2006.01)

(52) U.S. Cl. ..... 399/72; 399/28; 399/31; 399/74; 356/447

(58) Field of Classification Search ..... 399/28, 399/31, 32, 72, 74; 356/447
See application file for complete search history.

(56) References Cited

U.S. PATENT DOCUMENTS 5,278,589 A 1/1994 Wong
5,281,800 A 1/1994 Pelton et al.
5,365,074 A 11/1994 Genovese
6,690,430 B1 * 2/2004 Takeshita ..... 348/638
6,904,255 B2 6/2005 Kera et al.
7,177,585 B2 2/2007 Matsuzaka et al.
2002/0001477 A1 * 1/2002 Nakayasu ..... 399/49
2006/0104654 A1 * 5/2006 Borton et al. ..... 399/74

* cited by examiner

*Primary Examiner*—David M Gray
*Assistant Examiner*—Joseph S Wong
(74) *Attorney, Agent, or Firm*—Pillsbury Winthrop Shaw Pittman LLP

(57) ABSTRACT

An image printing system includes a print engine and a sensing system. The print engine is configured to print a marking material image on a image bearing surface. The sensing system includes a plurality of illuminators, a modulator, a sensor, and a demodulator. Each illuminator is configured to simultaneously emit a light beam at the marking material image on the image bearing surface, thereby producing reflectance from the marking material image at least in a first direction. The modulator is configured to modulate an intensity characteristic of each of the light beams emitted by the illuminators such that each light beam has a different modulated waveform characteristic, where the waveform characteristic includes at least frequency. The sensor is configured to detect the reflectance from the plurality of light beams in the first direction and output a reflectance signal. The demodulator is configured to demodulate the reflectance signal to isolate a response of the marking material image to each of the individual illuminators.

23 Claims, 4 Drawing Sheets

AMPLITUDE MODULATION OF ILLUMINATORS IN SENSING APPLICATIONS IN PRINTING SYSTEM

BACKGROUND

1. Field

This present disclosure relates to a system and a method for enabling sampling of a marking material image on a image bearing surface in response to a plurality of illuminators in an image printing system.

2. Description of Related Art

Optical sensors are commonly used in a variety of printing related applications. For instance, such optical sensors are often used to measure toner density on a image bearing surface (e.g. on photoreceptors, on intermediate belts, and on documents) in a printer system. Typically, sensors are designed to sample a response of a test patch on a image bearing surface to the incident light from one or more illuminators. Most of these devices make use of constant or steady illumination throughout the sampling process. In some cases, it is desirable to illuminate the test patch of interest with more than one wavelength of illumination (e.g., with three light emitting diodes (LEDs), such as red, green, and blue LEDs), or with more than one subset of wavelengths since illuminators have spectral content at a range of wavelengths. This is especially important in applications such as xerography where the different color toners respond in different ways depending on the wavelength of the illuminator.

There are two standard approaches for sampling the response of a test patch to multiple wavelengths of illumination. In the first approach, as shown in FIG. 1, a system 100 includes multiple illuminators 102 and 104, and a single sensor 106. The multiple illuminators 102 and 104 are configured to emit a light beam in a serial fashion (one at a time—i.e., sequential or alternating) at a test patch 108 on a image bearing surface 110 in order to isolate the response of the test patch to each illuminator 102 or 104 individually. The multiple illuminators 102 and 104 are sampled individually with the single sensor 106, where each illuminator 102 or 104 is pulsed on for a duration and the resultant reflectance is collected by the single sensor 106. This first approach applies to diffuse mode as well as specular mode measurements. In this first approach, because the responses are sampled in a serial fashion (one after the other), a sensing system requires a time equal to N·T to complete the sampling, where N is the number of different illuminators being used and T is the amount of time for sampling each individual illuminator, assuming the same amount of time for each illuminator. For example, when this first approach is applied to a LED spectrophotometer sensing system used in Xerox® systems, where eight different LEDs are pulsed individually, this sensing system requires a time equal to 8·T to sample each test patch of interest. Unfortunately, this type of sequential sampling requires more time to complete than sampling with a single illuminator (N*T versus just T where N is the number of different illuminators and T is the time required to sample each illuminator). In addition, since in many applications the image bearing surface 110 is moving past the sensor 106 at print process speed throughout the sampling interval, the test patches 108 must be sufficiently large to allow for sampling over this entire period of time (8T). For patches measured on customer documents, this will also require larger amounts of wasted documents for sensing.

In such applications, it would be highly desirable to speed up the time required for sampling a given test patch. In particular, the amount of time required to sample the response of the test patch to the required set of illuminators impacts the cyclic efficiency of the print engine (e.g., how long the print engine spends making customer documents versus the total amount of time the print engine is cycled-up and running) and the amount of customer media required for the sampling (e.g., the sensing systems like the Xerox® LED spectrophotometer take the measurements on a document and so must use customer media in their sampling). Thus, reducing the amount of time required to perform the sampling and/or reducing the size of the required test patches would be highly desirable in many printing applications.

A second approach, as shown in FIG. 2, for sampling the response of a test patch 208 to multiple illuminators 202 and 204 is to design sensor hardware such that all of the illuminators 202 and 204 can be tested at once. This second approach would enable sampling the response of the test patch 208 on a image bearing surface 210 to multiple illuminators 202 and 204 simultaneously in a single sampling instant, T.

This second approach provides an option to the one-at-a-time method disclosed in the first approach that may result in improvements in machine availability and document usage. However, there are several disadvantages associated with this second approach. It typically requires a specially designed hardware, such as a separate optical path (special lenses, wavelength specific optical filters 215 and 216, and optical sensors 206 and 207) and a separate analog-to-digital (A/D) converter for each desired illumination source 202 or 204. Because of these disadvantages, the second approach can result in more complex and costly sensing systems. In addition, because of the need to split the light (e.g., using a beam splitter 213) and use optical filtering (e.g., using wavelength specific optical filters 215 and 216) to select the appropriate frequencies of interest, this second approach suffers from a higher degree of loss in illumination. Thus, in this second approach, either stronger illuminators are required or the overall signal-to-noise ratio will likely suffer. Another disadvantage in the second approach is that often the received signal is a function of document orientation so that a receiver design should attempt to collect light from a circularly symmetric geometry. The second or multiple optical path approach to simultaneous illuminator sampling may not allow for this geometric design constraint to be satisfied. Thus, both the first and second sampling techniques, each have some disadvantages.

The present disclosure proposes a system that enables the sampling of the response of the test patch on the image bearing surface to each of the illuminators simultaneously, without requiring a separate optical path for each illuminator or specialized optical components to separate the frequencies of interest, and enabling a circularly symmetric receiver optical path. In other words, a single optical path and a single wideband optical detector can be used to achieve significant reductions in the required sampling time and/or sizes of the test patches.

SUMMARY

In an embodiment, an image printing system is provided. The image printing system includes a print engine and a sensing system. The print engine is configured to print a marking material image on a image bearing surface. The sensing system includes a plurality of illuminators, a modulator, a sensor, and a demodulator. Each illuminator is configured to simultaneously emit a light beam at the marking material image on the image bearing surface, thereby producing reflectance from the marking material image at least in a first direction. The modulator is configured to modulate an intensity characteristic of each of the light beams emitted by the illuminators such that each light beam has a different modulated waveform characteristic, where the waveform characteristic includes at least frequency. The sensor is configured to detect the reflectance from the plurality of light beams in the first direction and output a reflectance signal. The demodulator is configured to demodulate the reflectance signal to isolate a response of the marking material image to each of the individual illuminators.

In another embodiment, a method for enabling sampling of a marking material image on a image bearing surface in response to a plurality of illuminators in an image printing system is provided. The method includes operating each illuminator to simultaneously emit a light beam at the marking material image on the image bearing surface, thereby producing reflectance from the marking material image at least in a first direction; modulating an intensity characteristic of each of the light beams emitted by the illuminators such that each light beam has a different modulated waveform characteristic, the waveform characteristic including at least frequency; detecting the reflectance from the plurality of light beams in the first direction with a sensor to output a reflectance signal; and demodulating the reflectance signal to isolate a response of the marking material image to each of the individual illuminators.

In another embodiment, a system for detecting a characteristic of an image printed on a image bearing surface is provided. The system includes a plurality of illuminators, a modulator, a sensor, and a demodulator. Each illuminator is configured to simultaneously emit a light beam at the image on the image bearing surface, thereby producing reflectance from the image at least in a first direction. The modulator is configured to modulate an intensity characteristic of each of the light beams emitted by the illuminators such that each light beam has a different modulated waveform characteristic, where the waveform characteristic includes at least frequency. The sensor is configured to detect the reflectance from the plurality of light beams in the first direction and output a reflectance signal. The demodulator is configured to demodulate the reflectance signal to isolate a response of the image to each of the individual illuminators.

In another embodiment, a method for detecting a characteristic of an image printed on a image bearing surface in response to a plurality of illuminators is provided. The method includes operating each illuminator to simultaneously emit a light beam at the image on the image bearing surface, thereby producing reflectance from the image at least in a first direction; modulating an intensity characteristic of each of the light beams emitted by the illuminators such that each light beam has a different modulated waveform characteristic, the waveform characteristic including at least frequency; detecting the reflectance from the plurality of light beams in the first direction with a sensor to output a reflectance signal; and demodulating the reflectance signal to isolate a response of the image to each of the individual illuminators.

Other objects, features, and advantages of one or more embodiments will become apparent from the following detailed description, and accompanying drawings, and the appended claims.

BRIEF DESCRIPTION OF THE DRAWINGS

Various embodiments are disclosed, by way of example only, with reference to the accompanying schematic drawings in which corresponding reference symbols indicate corresponding parts, in which.

DETAILED DESCRIPTION

Figure 3:
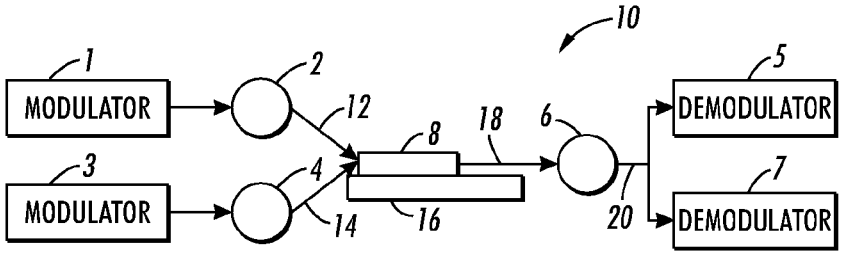
FIG. 3 shows a sensing system that uses modulation and demodulation techniques to sample a response of a test patch on a image bearing surface to multiple illuminators in accordance with an embodiment of the present disclosure.

The present disclosure proposes an image printing system that includes a print engine and a sensing system 10. The print engine is configured to print a marking material image 8 on a image bearing surface 16. FIG. 3 shows a block diagram of the sensing system 10 of present disclosure having two illuminators. It is contemplated that the sensing system 10 of the present disclosure is not limited to two illuminators, and may be easily extended to apply to any number of illuminators (and the number of illuminators is represented herein by the variable N). The sensing system 10 includes a plurality of illuminators 2 and 4, modulators 1 and 3, a sensor 6, and demodulators 5 and 7. Each illuminator 2 or 4 is configured to simultaneously emit a light beam 12 or 14 at the marking material image 8 on the image bearing surface 16, thereby producing reflectance 18 from the marking material image 8 at least in a first direction. The modulators 1 and 3 are configured to modulate an intensity characteristic of the light beams 12 and 14 emitted by the illuminators 2 and 4 respectively such that each light beam 12 or 14 has a different modulated waveform characteristic, where the waveform characteristic includes at least frequency. The sensor 6 is configured to detect the reflectance 18 from the plurality of light beams 12 and 14 in the first direction and output a reflectance signal 20. The demodulators 5 and 7 are configured to demodulate the reflectance signal 20 to isolate a response of the marking material image 8 on the image bearing surface 16 to each of the individual illuminators 2 or 4.

In U.S. patent application Ser. No. 11/833,633, incorporated herein by reference, it is proposed to modulate the illuminator in a sinusoidal fashion. This is done to improve signal-to-noise ratio for measurements under low mass conditions (using analysis of the signals in the frequency domain versus the time domain). In addition, by moving the signal of interest in frequency away from zero Hertz (or DC), noise sources at and around DC are avoided, resulting in a lower noise measurement. In one embodiment, DC refers to a static signal level (e.g. voltage or current) with all of its energy occurring at a specific frequency (e.g., zero Hertz). The present disclosure uses this concept of modulating the illuminator, but extends to create a novel and advantageous approach that enables the use of multiple illuminators and a single sensor which has its signal demodulated to isolate the responses to the individual illuminators.

In one embodiment, the marking material image is in the form of a toner image. In another embodiment, the marking material image is in the form of an inkjet image. In one embodiment, the toner image 8 is in the form of a test patch or a test pattern located on the image bearing surface 16. In one embodiment, a customized test pattern, which can be a series of evenly spaced patches, may be used to monitor a property (e.g., density, or color) of the toner image 8 using the sensor 6. In one embodiment, the test pattern contemplated may take a variety of forms but preferably takes the form of a recognizable bar code or sequence of colors in a convenient arrangement. In one embodiment, the test patch or test pattern may be located in a portion of the customer document.

In one embodiment, the image bearing surface 16 is at least one of a photoreceptor drum, a photoreceptor belt, an intermediate transfer belt, an intermediate transfer drum, a document, and other image bearing surfaces. That is, the term image bearing surface means any surface on which a toner image is received, and this may be the final surface (i.e., the printed document output from the device) or an intermediate surface (i.e., a drum or belt on which an image is formed prior to transfer to the printed document). For example, "tandem" xerographic color printing systems (e.g., U.S. Pat. Nos. 5,278,589; 5,365,074; 6,904,255 and 7,177,585, each of which are incorporated by reference), typically include plural print engines transferring respective colors sequentially to an intermediate image transfer surface (e.g., belt or drum) and then to the final substrate.

In one embodiment, the illuminators 2 and 4 comprise LEDs having different colors. In one embodiment, the illuminator may be in the form of a laser diode. For simplicity throughout the present disclosure, the case for two illuminators is described, however, the present disclosure can easily be extended to apply to N illuminators.

In one embodiment, the sensor 6 is at least one of a single wideband optical detector, photodiodes, APDs (avalanche photodiodes), PMTs (photomultiplier tubes), pyroelectric detectors, CMOS arrays, and CCD arrays.

In one embodiment, as noted above, the modulator is configured to modulate the amplitude of the illumination (i.e., not the frequency or wavelength). The result of the modulating the intensity of the illumination is a sinusoidal intensity waveform in output intensity of illumination. In one embodiment, the sinusoidal intensity waveform is then applied to the test patch or pattern of interest. In one embodiment, the resultant waveforms for different illuminators will have different frequencies.

The amount of light output by the illuminators is proportional to the amount of current used to drive the LEDs. $L_o(t,\lambda)$ is the light output (e.g., light beams 12 and 14) by the illuminators 2 and 4, or the total light incident upon the toner image 8 located on the image bearing surface 16. The equation representing the total light incident upon the toner image 8 located on the image bearing surface 16 from the illuminators 2 and 4 can then be written as follows:

$$L_o(t,\lambda)=\alpha_1(\lambda)\cdot[A_1\cos(\omega_1 t)+\delta_1]+\alpha_2(\lambda)\cdot[A_2\cos(\omega_2 t)+\delta_2] \quad (1)$$

where,

- $A_1$ and $A_2$ are the amplitudes of the sinusoidal waveforms applied to the illuminators 2 and 4, respectively
- $\omega_1$ and $\omega_2$ are the frequencies of the sinusoidal waveforms applied to the illuminators 2 and 4, respectively
- $\delta_1$ and $\delta_2$ are the DC offsets of the sinusoidal waveforms applied to the illuminators 2 and 4, respectively
- $\alpha_1$ and $\alpha_2$ are the proportionality constants that relate LED drive current to output light for the illuminators 2 and 4, respectively
- $\lambda$ is the wavelength parameter of the light beam The frequency $\omega$ of the sinusoidal waveform is the frequency at which the LED drive current for an LED is modulated. The proportionality constant $\alpha$ is written as a function of wavelength since most illuminators, like LEDs, are not perfectly tuned to output a single wavelength. Instead, the illuminators, like LEDS, generally output energy at a spectrum of wavelengths. The DC offset $\delta$ is required since the LED current cannot be negative and still produce output light.

The incident light beams 12 and 14 are configured to reflect off the toner image 8 located on the image bearing surface 16, and are modified in the process. The modified light output (e.g., reflectance 18) from the toner image 8 located on the image bearing surface 16 can be represented as follows:

$$L_r(t,\lambda)=\alpha_1(\lambda)\cdot R(\lambda,\underline{P})\cdot[A_1\cos(\omega_1 t)+\delta_1]+\alpha_2(\lambda)\cdot R(\lambda,\underline{P})\cdot[A_2\cos(\omega_2 t)+\delta_2] \quad (2)$$

where,

- $\underline{P}$ represents the properties of the test image bearing surface, specifically the color of the toner, or mass per unit area, of the toner, scattering properties of the toner (which is also a function of the size & shape of the toner), reflective properties of the image bearing surface, etc.
- R represents the reflectivity of the test patch, as a function of wavelength ($\lambda$) of light and the properties of the test patch ($\underline{P}$)

The voltage output of the sensor 6 receiving this input light (e.g., reflectance 18 from the plurality of light beams 12 and 14) can then be represented as:

$$V_d(t)=\beta_1\cdot[A_1\cos(\omega_1 t)+\delta_1]+\beta_2\cdot[A_2\cos(\omega_2 t)+\delta_2] \quad (3)$$

where

- $\beta_1$ and $\beta_2$ represent the aggregated information about the properties of the test patch ($\underline{P}$).

$\beta_1$ and $\beta_2$ are the combined responses of the LED illuminators 2 and 4, the sensor 6, and the toner image 8 on the image bearing surface 16 (all functions of wavelength) integrated over wavelength and over spatial extent of the toner image 8. The $\beta_1$ and $\beta_2$ constants are the signals of interest in the sensing system 10 as they encapsulate the behavior of the toner image 8 on the image bearing surface 16 (e.g., how the toner image 8 on the image bearing surface 16 interacts with the incident test light as a function of toner color and toner density). Equation 3 represents the output of the sensor for the case of two sinusoidally varying illuminators being applied simultaneously to the toner image of interest located on the image bearing surface. Equation 3 may easily be extended to represent more than two illuminators.

In a sensing system wherein a single, constant illuminator is applied to the toner image 8 located on the image bearing surface 16, the sensor voltage output would simply be the $\beta_i$ value times the constant LED current value ($I_o$), as in the following equation:

$$V_d(t)=\beta_1 \cdot I_o \tag{4}$$

This output voltage could then be very easily related to the parameters of the toner image 8 on the image bearing surface 16 through a simple calibration experiment, relating sensor voltage $V_d$ to toner density in the toner image 8 on the image bearing surface 16. After calibration, the sensor output voltage can then be used to estimate the toner mass density in the toner image 8 on the image bearing surface 16 using an identified empirical relationship.

In one embodiment, by measuring the amplitude of the received sinusoidal waveform, the reflectivity of the toner image may be determined and the amount of toner mass present may be estimated. For example, the amplitude A of the output light intensity $L_o(t,\lambda)$ is attenuated by the reflectance properties R of the toner image 8 on the image bearing surface 16. The degree to which this attenuation occurs may be used to determine the density (e.g., mass per unit area) of the toner image for a toner image of known toner color. This is generally accomplished by developing the aforementioned empirical relationship between the output sensor voltage and offline measurements of toner mass per unit area, at a fixed illumination setting. In one embodiment, the desired functional relationship between toner mass per unit area and measured sensor output voltage may be obtained using Equation 4 by holding the drive current constant and sweeping through various toner densities. The empirical relationship may then be used to estimate mass per unit area based on the measured output of the sensor.

For the case of multiple, cosine modulated illuminators, however, the individual contributions from the total received sensor voltage in Equation 3 can be separated. The $V_d(t)$ signal is demodulated to recover the individual responses of the toner image 8 on the image bearing surface 16 to each individual illuminator 2 or 4. Multiplying the sensor output by sinusoidal waveforms of the known input frequencies (e.g., the carrier frequencies used in the modulation step, and due to the insignificant time delays involved in transmission and reception, the phase relationship between transmission and reception can easily be maintained), the two signals $y_{d1}(t)$ and $y_{d2}(t)$ can be expressed as follows:

$$y_{d1}(t)=A_1\cos(\omega_1 t)\cdot\{\beta_1[A_1\cos(\omega_1 t)+\delta_1]+\beta_2[A_2\cos(\omega_2 t)+\delta_2]\}$$

$$y_{d2}(t)=A_2\cos(\omega_2 t)\cdot\{\beta_1[A_1\cos(\omega_1 t)+\delta_1]+\beta_2[A_2\cos(\omega_2 t)+\delta_2]\} \tag{5}$$

Multiplying through the first of these equations and using a trigonometric identity yields:

$$y_{d1}(t) = \frac{A_1^2}{2}\beta_1 + \frac{A_1^2}{2}\beta_1\cos(2\omega_1 t) + [\beta_1 A_1\delta_1 + \beta_2 A_1\delta_2]\cos(\omega_1 t) + \beta_2 A_1 A_2\cos(\omega_1 t)\cos(\omega_2 t) \tag{6}$$

By inspection, it can be appreciated that the frequency spectrum of this signal will consist of delta functions of different amplitudes at a handful of locations. To isolate the response caused by the first illuminator only, it is possible to focus only on the delta function that will occur at DC (e.g., the first term in the Equation 6) by simple low pass filtering. This would produce the following output signal:

$$y_1(t) = \frac{A_1^2}{2}\beta_1 \tag{7}$$

A comparison of the Equation 7 with Equation 4 shows that the demodulated signal is equivalent to what would have been obtained if a single LED illuminator with constant current ($A_1^2/2$) had been applied. Thus, a similar calibration scheme can be applied to obtain an empirical relationship between $y_1$ and the toner density in the test patch, just as would be done for the single, constant illuminator case.

The Equation 7 contains only parameters relating to the first illuminator 2, therefore, the demodulation procedure successfully isolated the toner image response to an individual illuminator. A similar analysis applied to the second equation of Equation 5 would enable the extraction of the contribution from the second illuminator 4. This approach may easily be extended to the case of N illuminators, all being modulated and applied simultaneously to the toner image on the image bearing surface.

Therefore, a simple low-pass filtering of the $y_{d1}(t)$ and $y_{d2}(t)$ signals in Equation 5 will isolate the signals of interest (the parameters of the image bearing surface that would relate to toner density and color, namely the $\beta_i$ values). Thus, by using amplitude modulation/demodulation techniques, multiple illuminators may be applied to the toner image on the image bearing surface simultaneously and the individual responses of each illuminator can be extracted.

The output of the illuminators is generally attenuated by the reflectance properties of the toner image, encapsulated in the $\beta_i$ values. For example, if the toner color or toner mass density are changed, then the corresponding $\beta_i$ values will change as well. The $\beta_i$ values that encapsulate the reflectance properties (e.g., the toner color, toner density, etc) of the toner image 8 have been assumed to be constant in the above discussed analysis. However, in one embodiment, $\beta_i$ values may be assumed to vary or to be non-uniform/non-constant. For example, it may be assumed that the toner image 8 varies with time (or spatially along the document as the relative location of the sensor with respect to the document changes over time). In one such embodiment, rather than obtaining delta functions $\delta_1$ and $\delta_2$ in the frequency spectrum at a set of frequency locations of the signals $y_{d1}(t)$ and $y_{d2}(t)$ in Equation 5, the frequency spectrum of the original time-varying signals $\beta_i(t)$ centered at these same locations may be obtained. So long as the frequency content of the signals $\beta_i(t)$ of interest are sufficiently band-limited such that there is no overlap between the frequency spectra, a low-pass filtering of the signals $y_{d1}(t)$ and $y_{d2}(t)$ in Equation 5 may be done to obtain the frequency spectrum of the desired signals of interest. Thus, the present disclosure may enable measurement of non-uniformities (e.g. banding) in the toner image 8 as well as their DC level. In one embodiment, the modulation frequency and low pass filter cutoff frequency may be chosen to be consistent with the expected bandwidth of the non-uniformity signal.

The output signal for non-constant test patches obtained from the filter process can be written as follows:

$$y_i(t) = \frac{A_i^2}{2}\beta_i(t)$$

where $A_i$ is the amplitude of the sinusoidal waveform applied to the $i_{th}$ illuminator $\beta_i(t)$ is the non-constant aggregated information about the properties of the test patch (P).

If a non-uniform toner image (e.g., a toner image that contains banding artifacts) is sampled using a serial sampling technique (e.g., by pulsing the LEDs one-at-a-time and measuring their individual response), then the different illuminators may be applied to different phases of the banding artifact. This may have significant impact on the overall measurement system if not accounted for. On the contrary, in the present disclosure, the response of the non-uniform toner image to different illuminators is measured at the same instant in time providing an advantage over serial sampling techniques.

In one embodiment, the sensing system 10 may include a processor (not shown) that is coupled to the sensing system 10. The processor is configured to determine a density of a layer of the toner image 8 on the image bearing surface 16 based on the reflectance 18 detected by the sensor, and to adjust the printing system based on the density of the layer of the toner image 8. In another embodiment, the processor is configured to determine a toner color of the toner image 8 on the image bearing surface 16 based on the reflectance 18 detected by the sensor, and to adjust the printing system based on the toner color of the toner image 8.

In one embodiment, a sine modulation, a cosine modulation, or a combination of sine and cosine modulation is applied to the light beams 12 and 14 emitted by the illuminators 2 and 4 before being incident on the toner image 8 on the image bearing surface 16. In one embodiment, a sine demodulation, a cosine demodulation, or a combination of sine and cosine demodulation, corresponding to the original modulation, is applied to the signal 20 determined by the reflectance 18 from the toner image 8 on the image bearing surface 16 to isolate the response of the toner image 8 on the image bearing surface 16 to each of the individual illuminators 2 or 4.

In one embodiment, all of the amplitude modulation/demodulation techniques may be performed in hardware prior to the analog-to-digital (A/D) conversion process. In such embodiment, all of the required processing for the modulation and demodulation of the signals of interest can be performed entirely in the analog domain. In another embodiment, a high-speed analog-to-digital (A/D) converter may be utilized to capture the voltage output signal $V_d(t)$ of the sensor 6. The voltage output signal $V_d(t)$ of the sensor 6 may then be analyzed and demodulated entirely in the digital domain. The advantage of such embodiment is the ease of modification of algorithms (e.g., changes in the software rather than changes in the hardware).

In one embodiment, since all of the N illuminator response signals (e.g., $y_i(t)$, where i represents the $i^{th}$ illuminator) are available in parallel, the sensing system 10 may use parallel analog-to-digital (A/D) converters to sample the signals simultaneously. Alternatively, the sensing system 10 may use a high-speed analog-to-digital (A/D) converter to sample the voltage output signal $V_d(t)$ of the sensor 6 directly. In such embodiment, as noted above, the voltage output signal $V_d(t)$ may then be demodulated in the digital domain, rather than in analog hardware.

Figure 1:
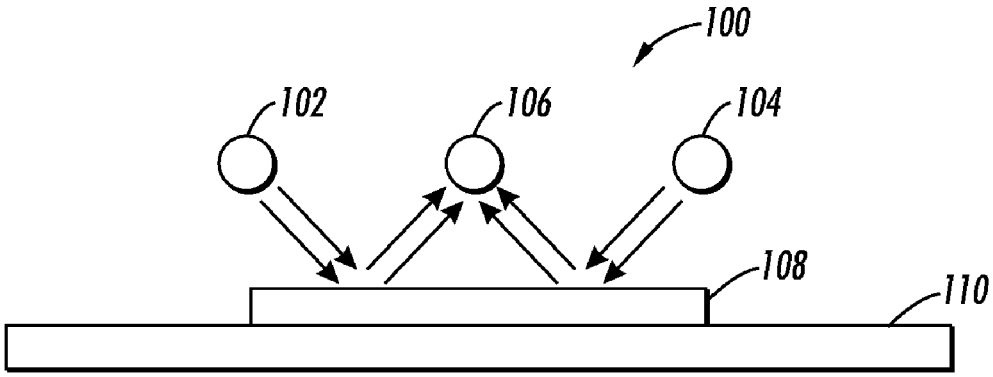
FIG. 1 shows a sensing system having a single sensor and multiple illuminators that is used for sampling a response of a test patch on a image bearing surface to multiple illuminators.
Figure 2:
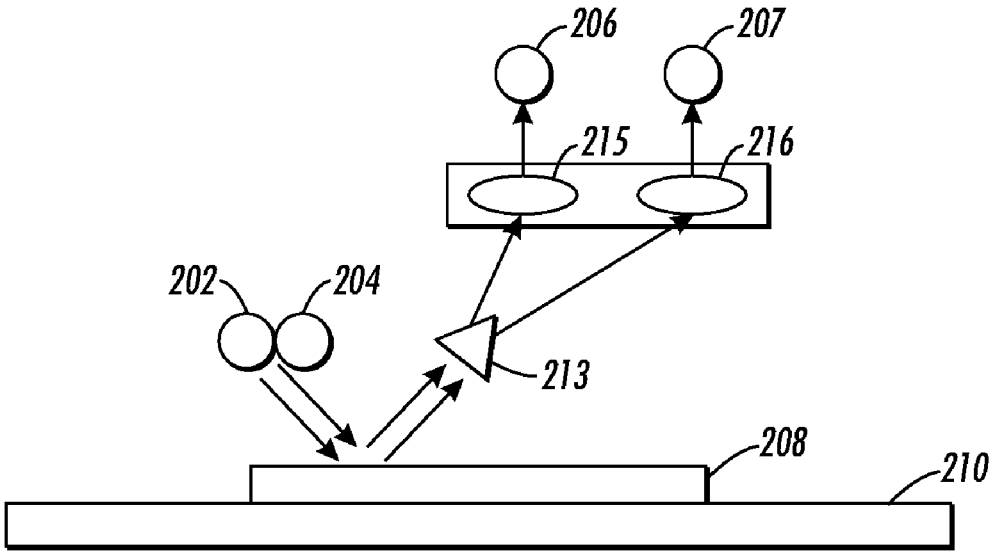
FIG. 2 shows a sensing system having multiple sensors and multiple illuminators that is used for sampling a response of a test patch on a image bearing surface to multiple illuminators.

Thus, the sensing system 10 of the present disclosure is configured to modulate the output light intensity of the illuminators 2 and 4 in sinusoidal fashion, emit this combined illumination signal onto the toner image 8 located on the image bearing surface 16, gather the total reflectance 18 at the single sensor 6, then mix this received signal with the same sinusoidal waveforms used in the modulation step, and finally post-filter to isolate the signals of interest. This will enable sampling the response of a test patch to multiple illumination sources simultaneously. The sensing system 10 of the present disclosure is equivalent to using a sensing system such as that shown in FIG. 1, but where both illuminators are applied simultaneously.

Figure 4:
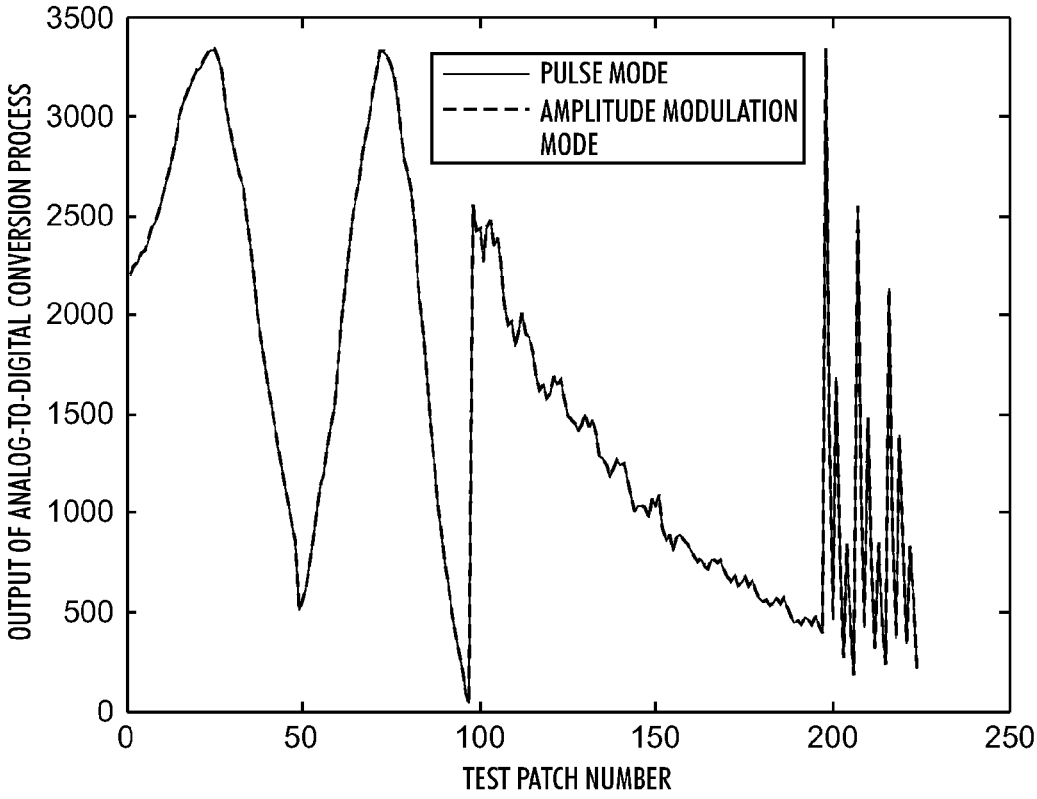
FIG. 4 shows a graph for an LED in a spectrophotometer illustrating the simulated output of the analog-to-digital conversion process for pulse (one-at-a-time) sensing system and amplitude modulation sensing system in accordance with an embodiment of the present disclosure.

FIG. 4 shows a graph for an LED based spectrophotometer sensing system illustrating the simulated output of the analog-to-digital conversion process for a sequence of 224 simulated color test patches for pulse (one-at-a-time) sensing approach and amplitude modulation sensing approach.

For each of 224 simulated color test patches, the sensor was simulated in both the one-at-a-time or pulse mode (e.g., where each LED is individually pulsed on) and in the amplitude modulation mode where all eight of the LED's were illuminated at once. The graph as shown in FIG. 4 illustrates the test patch number on a horizontal x-axis. On a vertical y-axis, the graph illustrates the output of the analog-to-digital conversion process in Volts. The output of the analog-to-digital conversion process is obtained for each of 224 simulated color test patches using the two sensing approaches.

As shown in FIG. 4, the outputs of the analog to digital (A/D) converter for the sensing system appear to be same for 224 simulated color test patches whether the eight LEDs of the spectrophotometer were pulsed individually (e.g., in a serial fashion) or whether the proposed amplitude modulation/demodulation technique was applied to sample the output of the sensing system for all eight LEDs at one time.

Figure 5:
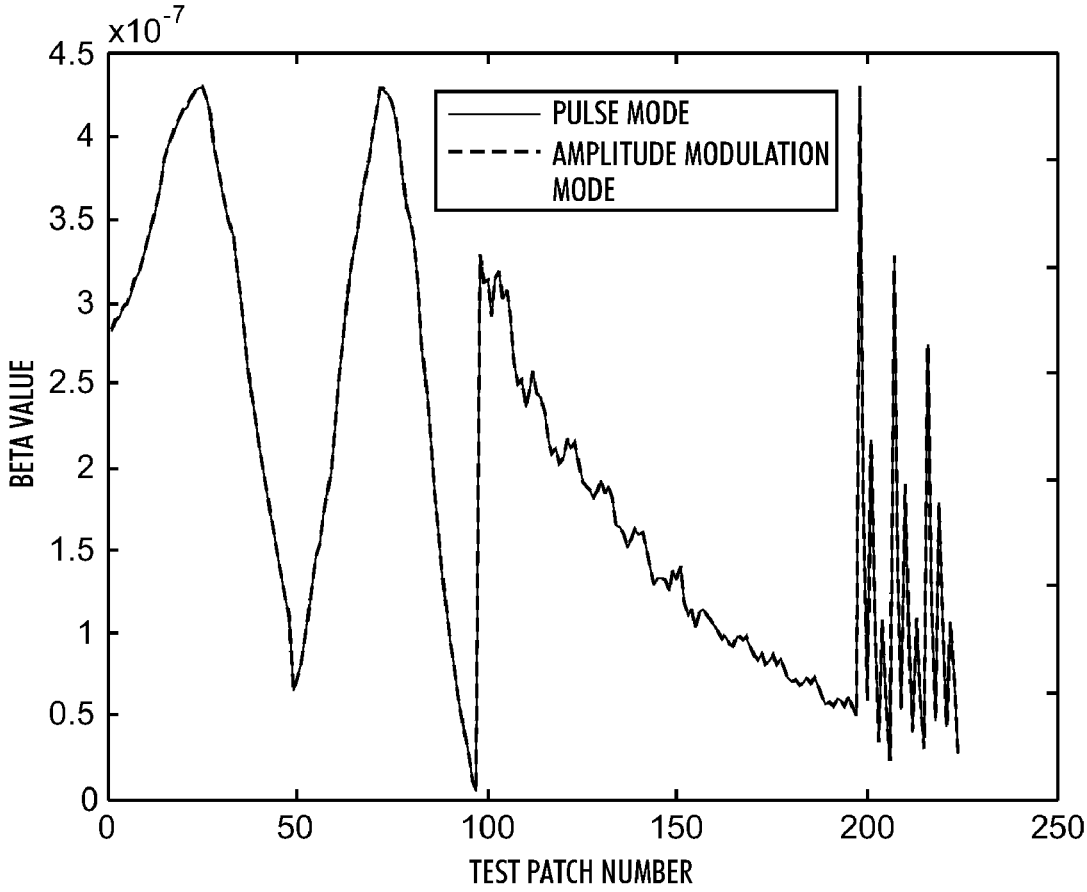
FIG. 5 shows a graph for an LED in the spectrophotometer illustrating the aggregated information about the test patch properties for pulse (one-at-a-time) sensing system and amplitude modulation sensing system in accordance with an embodiment of the present disclosure.

FIG. 5 shows a graph for an LED based spectrophotometer sensing system illustrating the aggregated information about the test patch properties for a sequence of 224 simulated color test patches for pulse (one-at-a-time) sensing approach and amplitude modulation sensing approach.

For each of 224 simulated color test patches, the sensor was simulated in both the one-at-a-time or pulse mode (e.g., where each LED is individually pulsed on) and in the amplitude modulation mode where all eight of the LED's were illuminated at once. The graph as shown in FIG. 5 illustrates the test patch number on a horizontal x-axis. On a vertical y-axis, the graph illustrates the $\beta_i$ values (e.g., where i represents the $i^{th}$ illuminator) in Volts per milliamperes (V/mA). The $\beta_i$ values are obtained for each of 224 simulated color test patches using the two sensing approaches. As noted above, the $\beta_i$ values encapsulate the reflectance properties (e.g., toner color or toner density) of the test patches that are to be measured by the sensing system.

As shown in FIG. 5, the $\beta_i$ values for the sensing system appear to be same for 224 simulated color test patches whether the eight LEDs of the spectrophotometer were pulsed individually (e.g., in a serial fashion) or whether the proposed amplitude modulation/demodulation technique was applied to sample the output of the sensing system for all eight LEDs at one time.

Thus, for the spectrophotometer, the output of the sensing system and the aggregated information about the test patch properties are identical in simulating of the two sampling techniques, but the amount of time required to make the measurements using the present disclosure is eight times shorter than that for the pulsed sampling technique. Thus, the sensing technique of the present disclosure provides an improvement in up-time of the image printing system and a reduction in the amount of customer media required to make the measurements.

In the spectrophotometer applications, the sensing is done on customer media (i.e. paper). In some embodiments, this sensing is done on customer media, but not on the output customer documents. For example, some applications use special test patterns printed in the margins of the customer's media that are then trimmed later. In other words, special test pages are printed with test patterns on them and these special test pages are used in sensing.

In one embodiment, since essentially the same amount of light is detected for each LED relative to the pulse sensing technique, the signal-to-noise ratio is the same for both pulse and amplitude modulation/demodulation sensing techniques. In one embodiment, the noise sources at and around DC are avoided because the signal of interest is modulated to a different frequency. In one embodiment, the amplitude modulation/demodulation sensing technique requires an increased dynamic range to accommodate measuring all LEDs simultaneously. The increase is roughly equal to square root of N (e.g., where N is the number of LEDs) times larger and can be optimized by choosing appropriate modulation frequencies.

Figure 6:
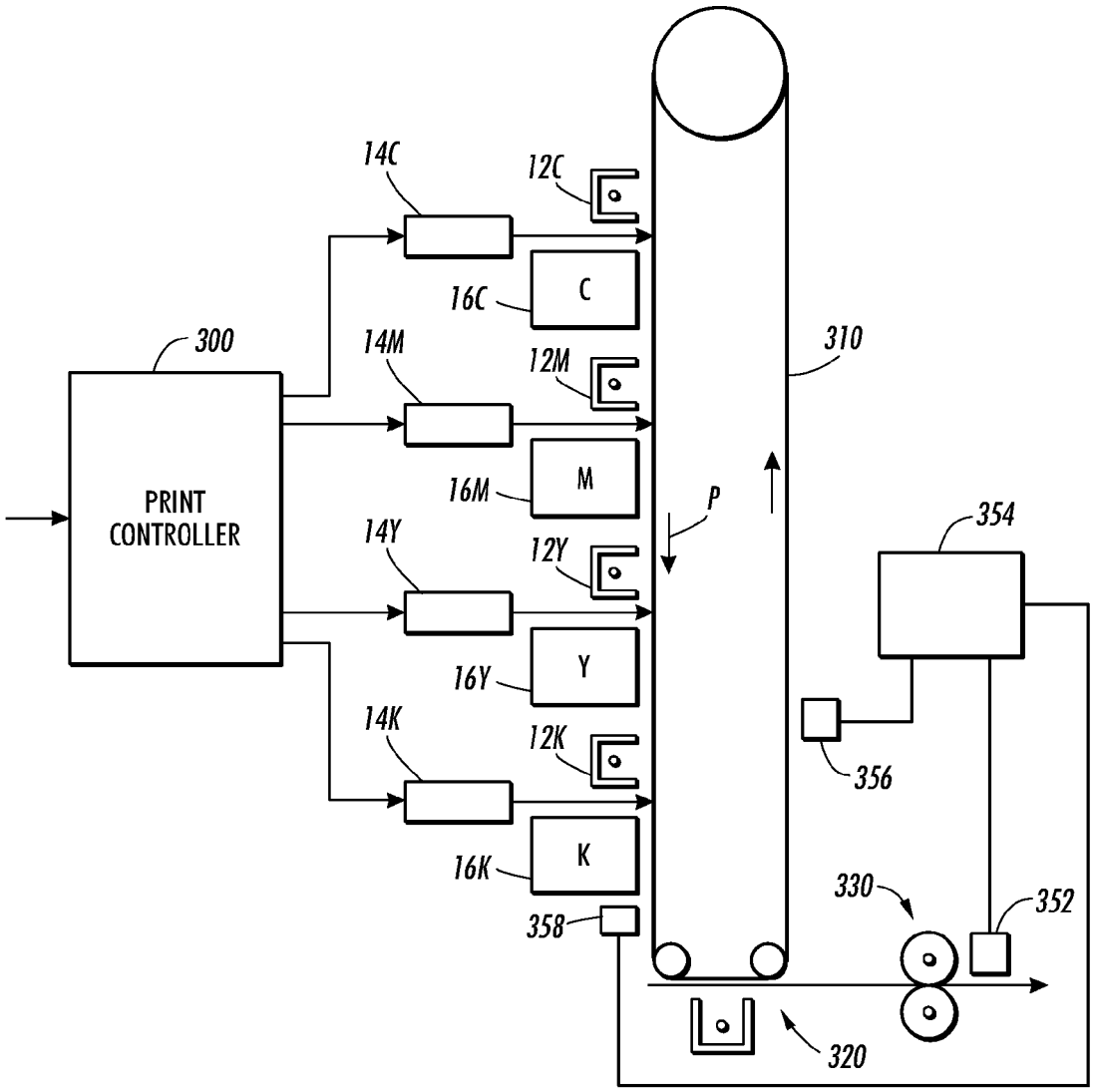
FIG. 6 is a simplified elevational view of basic elements of a xerographic printer, showing a context of the various embodiments of the present disclosure.

FIG. 6 is a simplified elevational view of basic elements of a color printer, showing a context of the present disclosure. Specifically, there is shown an "image-on-image" xerographic color printer, in which successive primary-color images are accumulated on a photoreceptor belt, and the accumulated superimposed images are in one step directly transferred to an output sheet as a full-color image. In one implementation, the Xerox Corporation iGen3® digital printing press may be utilized. However, it is appreciated that any printing machine, such as monochrome machines using any technology, machines which print on photosensitive image bearing surfaces, xerographic machines with multiple photoreceptors, or ink-jet-based machines, can beneficially utilize the present disclosure as well.

Specifically, the FIG. 6 embodiment includes a belt photoreceptor 310, along which are disposed a series of stations, as is generally familiar in the art of xerography, one set for each primary color to be printed. For instance, to place a cyan color separation image on photoreceptor 310, there is used a charge corotron 12C, an imaging laser 14C, and a development unit 16C. For successive color separations, there is provided equivalent elements 12M, 14M, 16M (for magenta), 12Y, 14Y, 16Y (for yellow), and 12K, 14K, 16K (for black). The successive color separations are built up in a superimposed manner on the surface of photoreceptor 310, and then the combined full-color image is transferred at transfer station 320 to an output sheet. The output sheet is then run through a fuser 330, as is familiar in xerography.

Also shown in the FIG. 6 is a set of what can be generally called "monitors," such as 358 and 352, which can feed back to a control device 354. The monitors such as 358 and 352 are devices which can make measurements to images created on the photoreceptor 310 (such as monitor 358) or to images which were transferred to an output sheet (such as monitor 352). These monitors can be in the form of optical densitometers, colorimeters, array based optical densitometers, electrostatic voltmeters, etc. There may be provided any number of monitors, and they may be placed anywhere in the printer as needed, not only in the locations illustrated. The information gathered therefrom is used by control device 354 in various ways to aid in the operation and/or performance of the printer, whether in a real-time feedback loop, an offline calibration process, a registration system, etc.

Typically, a printer using control systems which rely on monitors such as 358, 352 require the deliberate creation of what shall be here generally called "test patches" which are made and subsequently measured in various ways by one or another monitor. These test marks may be in the form of test patches of a desired darkness value, a desired color blend, or a particular shape, such as a line pattern; or they may be of a shape particularly useful for determining registration of superimposed images ("fiducial" or "registration" marks). Various image-quality systems, at various times, will require test marks of specific types to be placed on photoreceptor 310 at specific locations. These test marks will be made on photoreceptor 310 by one or more lasers such as 14C, 14M, 14Y, and 14K. This printing process may be controlled, for example, by a print controller 300.

As is familiar in the art of "laser printing," by coordinating the modulation of the various lasers with the motion of photoreceptor 310 and other hardware (such as rotating mirrors, etc., not shown), the lasers discharge areas on photoreceptor 310 to create the desired test marks, particularly before these areas are developed by their respective development units 16C, 16M, 16Y, 16K. The test marks must be placed on the photoreceptor 310 in locations where they can be subsequently measured by a (typically fixed) monitor elsewhere in the printer, for whatever purpose.

In an embodiment, the sensing system 10, as described above, can be placed just before or just after the transfer station 320 where the toner is transferred to the sheet, for example, on monitors such as 358, 356. In another embodiment, the sensing system 10, may be placed to measure directly on a printed sheet as the printed sheet comes out of the machine, for example, on monitor such as 352.

EXAMPLES

The sensing technique described in the present disclosure, and the resultant gains in sampling time and/or reductions in required test patch sizes, are useful in many printing related sensing applications.

One example is a Xerox® low cost LED (LCLED) spectrophotometer. As noted above, the Xerox® LED spectrophotometer is a multiple illuminator sensing system that requires sampling of the test patch response to eight different LEDs. Currently, the sampling is performed by pulsing eight individual LEDs on one at a time and measuring the response with a single sensor, as discussed in the background section. The present disclosure instead enables sampling of the response of the test patch to all eight LEDs in a single sampling instant without adding significant additional costs to the design. Therefore, the present disclosure may provide up to a factor of eight improvement in the sampling time for this multiple illuminator sensing system. This means that an approximately 240 pages color calibration may be reduced to an approximately 30 pages color calibration. This also could mean that eight times more test patches may be read in the same physical document size. Also, the present disclosure may provide benefits of up-time of the image printing system as well as a reduction in the amount of customer media required to perform a color calibration cycle.

Another example is a scanbar sensing system. In flat-bed scanners or document feeders on copiers, these scanbar sensing systems typically use multiple illuminators (e.g., red, green, blue LEDs) to measure the response of the document being scanned. By measuring with multiple illuminators, the scanbar sensing system can then generate a three plane color image of the document that was scanned. Currently, in many scanbar sensing applications, the response of the document being scanned to each of the illuminator is measured one at a time (e.g., in a serial fashion). This requires either slower motion of the scanbar (or document) or smaller integration times for the sensor to prevent loss of sampling resolution in one dimension. In other scanbar sensing applications, the sensor is specially designed with multiple optical paths (e.g., one for each sensor) and optical filters to enable sampling the response of the document to multiple illuminators simultaneously. This increases the cost and complexity for the scanbar sensing system. The present disclosure enables sampling of the response of the document to multiple illuminators simultaneously, without requiring complicated design of the scanbar sensing system. Thus, the present disclosure may provide the benefits of higher speed scanning in the scanbar sensing system without adding significant cost to the scanbar sensing system.

While the specific embodiments of the present disclosure have been described above, it will be appreciated that the disclosure may be practiced otherwise than described. The description is not intended to limit the disclosure.

What is claimed is:

1. An image printing system, the system comprising:

a print engine for creating a marking material image on an image bearing surface;

a sensing system comprising:

a plurality of illuminators each configured to simultaneously emit a light beam at the marking material image on the image bearing surface, thereby producing reflectance from the marking material image at least in a first direction;

a modulator for modulating an intensity characteristic of each of the light beams emitted by the illuminators such that each light beam has a different modulated waveform characteristic, the waveform characteristic including at least frequency;

a sensor configured to detect the reflectance from the plurality of light beams in the first direction and output a reflectance signal; and a demodulator for demodulating the reflectance signal to isolate a response of the marking material image to each of the individual illuminators.

2. The system of claim 1, further comprising a processor coupled to the sensing system, wherein the processor is configured to determine a density of the marking material image on the image bearing surface based on the isolated response of the marking material image to each of the individual illuminators as detected by the sensor, and to adjust the printing system based on the density of the marking material image.

3. The system of claim 1, further comprising a processor coupled to the sensing system, wherein the processor is configured to determine a color of the marking material image on the image bearing surface based on the isolated response of the marking material image to each of the individual illuminators as detected by the sensor, and to adjust the printing system based on the color of the marking material image.

4. The system of claim 1, wherein the image bearing surface is at least one of a photoreceptor drum, a photoreceptor belt, an intermediate transfer belt, an intermediate transfer drum, an imaging drum, a document, and other image bearing surfaces.

5. The system of claim 1, wherein the illuminators comprise LEDs having different illumination spectra.

6. The system of claim 1, wherein the sensor is at least one of a single wideband optical detector, a photodiode, an avalanche photodiode, a photomultiplier tube, a pyroelectric detector, a CMOS array, and a charge-coupled device (CCD) array.

7. The system of claim 1, wherein the modulator is configured to apply a sine modulation, a cosine modulation, or a combination of sine and cosine modulation to the light beams emitted by the illuminators before being incident on the marking material image on the image bearing surface.

8. The system of claim 1, wherein the demodulator is configured to apply a sine demodulation, a cosine demodulation, or a combination of sine and cosine demodulation to the reflectance signal to isolate the response of the marking material image on the image bearing surface to each of the individual illuminators.

9. The system of claim 1, wherein the marking material image is a toner image.

10. The system of claim 1, wherein the marking material image is an inkjet image.

11. A method for enabling sampling of a marking material image on a image bearing surface in response to a plurality of illuminators in an image printing system, the method comprising:

operating each illuminator to simultaneously emit a light beam at the marking material image on the image bearing surface, thereby producing reflectance from the marking material image at least in a first direction;

modulating an intensity characteristic of each of the light beams emitted by the illuminators such that each light beam has a different modulated waveform characteristic, the waveform characteristic including at least frequency;

detecting the reflectance from the plurality of light beams in the first direction with a sensor to output a reflectance signal; and demodulating the reflectance signal to isolate a response of the marking material image to each of the individual illuminators.

12. The method of claim 11, further comprising providing a processor, wherein the processor is configured to determine a density of the marking material image on the image bearing surface based on the isolated response of the marking material image to each of the individual illuminators as detected by the sensor, and to adjust the printing system based on the density of the marking material image.

13. The method of claim 11, further comprising providing a processor, wherein the processor is configured to determine a color of the marking material image on the image bearing surface based on the isolated response of the marking material image to each of the individual illuminators as detected by the sensor, and to adjust the printing system based on the color of the marking material image.

14. The method of claim 11, wherein the image bearing surface is at least one of a photoreceptor drum, a photoreceptor belt, an intermediate transfer belt, an intermediate transfer drum, an imaging drum, a document, and other image bearing surfaces.

15. The method of claim 11, wherein the illuminators comprise LEDs having different illumination spectra.

16. The method of claim 11, wherein the sensor is at least one of a single wideband optical detector, a photodiode, an avalanche photodiode, a photomultiplier tube, a pyroelectric detector, a CMOS array, and a charge-coupled device (CCD) array.

17. The method of claim 11, wherein a sine modulation, a cosine modulation, or a combination of sine and cosine modulation is applied to the light beams emitted by the illuminators before being incident on the marking material image on the image bearing surface.

18. The method of claim 11, wherein a sine demodulation, a cosine demodulation, or a combination of sine and cosine demodulation is applied to the reflectance signal to isolate the response of the marking material image on the image bearing surface to each of the individual illuminators.

19. The method of claim 11, further comprising printing the marking material image on the image bearing surface using a print engine.

20. The method of claim 11, wherein the marking material image is a toner image.

21. The method of claim 11, wherein the marking material image is an inkjet image.

22. A system for detecting a characteristic of an image printed on a image bearing surface, the system comprising:

a plurality of illuminators each configured to simultaneously emit a light beam at the image on the image bearing surface, thereby producing reflectance from the image at least in a first direction;

a modulator for modulating an intensity characteristic of each of light beams emitted by the illuminators such that each light beam has a different modulated waveform characteristic, the waveform characteristic including at least frequency;

a sensor configured to detect the reflectance from the plurality of light beams in the first direction and output a reflectance signal; and a demodulator for demodulating the reflectance signal to isolate a response of the image to each of the individual illuminators.

23. A method for detecting a characteristic of an image printed on a image bearing surface in response to a plurality of illuminators, the method comprising:

operating each illuminator to simultaneously emit a light beam at the image on the image bearing surface, thereby producing reflectance from the image at least in a first direction;

modulating an intensity characteristic of each of the light beams emitted by the illuminators such that each light beam has a different modulated waveform characteristic, the waveform characteristic including at least frequency;

detecting the reflectance from the plurality of light beams in the first direction with a sensor to output a reflectance signal; and demodulating the reflectance signal to isolate a response of the image to each of the individual illuminators.

* * * * *